US010563657B2

(12) United States Patent
Kang et al.

(10) Patent No.: US 10,563,657 B2
(45) Date of Patent: Feb. 18, 2020

(54) TURBOFAN FOR AIR CONDITIONING APPARATUS

(71) Applicant: Samsung Electronics Co., Ltd., Suwon-si (KR)

(72) Inventors: Yong-hun Kang, Seoul (KR); Eung-ryeol Seo, Suwon-si (KR); Jin-baek Kim, Suwon-si (KR); Hyun-joo Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 666 days.

(21) Appl. No.: 15/283,651

(22) Filed: Oct. 3, 2016

(65) Prior Publication Data

US 2017/0101993 A1 Apr. 13, 2017

(30) Foreign Application Priority Data

Oct. 7, 2015 (KR) ..... 10-2015-0141189

(51) Int. Cl.
*F04D 17/16* (2006.01)
*F04D 29/30* (2006.01)
(Continued)

(52) U.S. Cl.
CPC ..... *F04D 17/16* (2013.01); *F01D 5/141* (2013.01); *F04D 25/06* (2013.01); *F04D 29/023* (2013.01);
(Continued)

(58) Field of Classification Search
CPC ..... F04D 17/16; F04D 25/06; F04D 29/023; F04D 29/281; F04D 29/30;
(Continued)

(56) References Cited

U.S. PATENT DOCUMENTS 4,647,271 A * 3/1987 Nagai ..... F04D 29/281 416/186 R
6,007,300 A * 12/1999 Saeki ..... F04D 29/283 416/178
(Continued)

FOREIGN PATENT DOCUMENTS

CN 1501001 A 6/2004
CN 102644625 8/2012
(Continued)

OTHER PUBLICATIONS

International Search Report dated Dec. 14, 2016 in corresponding International Patent Application No. PCT/KR2016/011101.
(Continued)

*Primary Examiner* — Justin D Seabe
*Assistant Examiner* — Joshua R Beebe
(74) *Attorney, Agent, or Firm* — Staas & Halsey LLP

(57) ABSTRACT

A turbofan for an air conditioning apparatus includes a shroud at a center of which a suction port is formed; a hub plate which is spaced apart in a vertical direction from the shroud and has a diameter smaller than a diameter of the suction port; and a plurality of blades provided between the hub plate and the shroud in a circumferential direction, wherein a portion of each of the plurality of blades which faces the suction port of the shroud is formed in a curved portion inclined with respect to the hub plate, and an outer circumference of the hub plate is provided with a plurality of notches each of which is formed between adjacent two blades among the plurality of blades.

13 Claims, 23 Drawing Sheets

(51) Int. Cl.

| | |
|---|---|
| ***F04D 29/68*** | (2006.01) |
| ***F04D 29/28*** | (2006.01) |
| ***F04D 29/02*** | (2006.01) |
| ***F01D 5/14*** | (2006.01) |
| ***F04D 25/06*** | (2006.01) |
| ***F04D 29/42*** | (2006.01) |

(52) U.S. Cl.
CPC ..... *F04D 29/281* (2013.01); *F04D 29/30* (2013.01); *F04D 29/4226* (2013.01); *F04D 29/681* (2013.01); *F05D 2240/303* (2013.01); *F05D 2250/70* (2013.01)

(58) Field of Classification Search
CPC .... F04D 29/4226; F04D 29/681; F01D 5/141; F05D 2240/303; F05D 2250/70
See application file for complete search history.

(56) References Cited

U.S. PATENT DOCUMENTS

| | | | | |
|---|---|---|---|---|
| 6,558,120 | B2 * | 5/2003 | Kim | F04D 25/12 416/186 R |
| 6,746,210 | B2 * | 6/2004 | Kim | B29C 45/33 416/181 |
| 8,167,562 | B2 * | 5/2012 | Sakai | F04D 29/282 416/178 |
| 8,257,043 | B2 * | 9/2012 | Kuroki | F04D 29/282 416/186 R |
| 8,915,698 | B2 | 12/2014 | Jeon et al. | |
| 2002/0023728 | A1 * | 2/2002 | Kikuchi | B22D 17/04 164/113 |
| 2003/0039548 | A1 * | 2/2003 | Kim | F04D 29/023 416/186 R |
| 2004/0247441 | A1 * | 12/2004 | Kim | F04D 29/023 416/179 |
| 2006/0140758 | A1 * | 6/2006 | Ochiai | F04D 29/282 415/206 |
| 2010/0202886 | A1 | 8/2010 | Iwata et al. | |
| 2012/0121422 | A1 * | 5/2012 | Kim | F04D 29/281 416/185 |
| 2012/0213637 | A1 | 8/2012 | Jeon et al. | |
| 2012/0315135 | A1 | 12/2012 | Sato et al. | |
| 2014/0133988 | A1 | 5/2014 | Son et al. | |
| 2015/0071781 | A1 * | 3/2015 | Kurihara | F04D 29/282 416/186 R |
| 2015/0192143 | A1 * | 7/2015 | Sakai | F04D 29/30 415/203 |

FOREIGN PATENT DOCUMENTS

| | | | | |
|---|---|---|---|---|
| CN | 104791298 | A | 7/2015 | |
| EP | 2441963 | A1 | 4/2012 | |
| EP | 2492513 | | 8/2012 | |
| JP | 06305343 | A * | 11/1994 | B29C 45/1704 |
| JP | 2002-347080 | | 12/2002 | |
| JP | 2005-127241 | A | 5/2005 | |
| JP | 2014-238037 | A | 12/2014 | |
| JP | 2015-102003 | | 6/2015 | |
| KR | 10-0421391 | | 3/2004 | |
| KR | 10-0535679 | | 12/2005 | |
| KR | 10-2009-0041467 | | 4/2009 | |
| KR | 10-2012-0096261 | | 8/2012 | |
| KR | 10-2014-0060896 | | 5/2014 | |

OTHER PUBLICATIONS

International Written Opinion dated Dec. 14, 2016 in corresponding International Patent Application No. PCT/KR2016/011101.
Extended European Search Report dated May 23, 2018 in corresponding European Patent Application No. 16853868.4, 9 pgs.
European Communication dated Dec. 18, 2018 in European Patent Application No. 16853868.4.
Chinese Office Action dated Apr. 1, 2019 in Chinese Patent Application No. 201680057667.2.
European Office Action dated Oct. 9, 2019 from European Patent Application No. 16853868.4, 5 pages.
Chinese Office Action dated Nov. 25, 2019 from Chinese Patent Application No. 201680057667.2, 22 pages.

* cited by examiner

TURBOFAN FOR AIR CONDITIONING APPARATUS

CROSS-REFERENCE TO RELATED APPLICATIONS

This application claims priority from Korean Patent Application No. 10-2015-0141189 filed Oct. 7, 2015 in the Korean Intellectual Property Office, the disclosure of which is incorporated herein by reference in its entirety.

BACKGROUND

1. Field

The present disclosure relates to a turbofan used in an air conditioning apparatus. More particularly, the present disclosure relates to a similar three-dimensional turbofan that can be manufactured by upper and lower dies without use of complex multiple slide dies and has performance improved than a two-dimensional turbofan, and an air conditioning apparatus using the same.

2. Description of the Related Art

A turbofan which is widely used in air conditioning apparatuses is configured of a shroud, a hub plate, and a plurality of blades arranged circumferentially between the shroud and the hub plate.

Such a turbofan may be classified into a two-dimensional turbofan and a three-dimensional turbofan in accordance with a shape of the blade.

Because a two-dimensional turbofan 100, as illustrated in FIGS. 1A and 1B, has a structure in which a plurality of blades 130 is disposed perpendicular to a hub plate 110 and a shroud 120, the two-dimensional turbofan 100 may be molded as a single body that the shroud 120, the hub plate 110, and the plurality of blades 130 are formed integrally by using a mold that can be separated up and down.

Because the structure of the mold is simple, the production cost of the two-dimensional turbofan 100 is low. However, because the shape of the blade 130 cannot be freely designed, there is a limitation to improve power consumption and noise of the two-dimensional turbofan 100.

On the other hand, as illustrated in FIG. 2, a three-dimensional turbofan 200 is formed so that a hub plate 210, a shroud 220, and a plurality of blades 230 are molded by a separate mold, respectively, and then these parts are welded by ultrasonic welding or laser welding.

Because the shape of the blade 230 can be freely designed and manufactured, the three-dimensional turbofan 200 has advantage in the power consumption and noise compared to the two-dimensional turbofan 100. However, in the production side, the three-dimensional turbofan 200 has a disadvantage that the production cost is high since three kinds of molds are used for molding the hub plate 210, the shroud 220, and the blades 230 and the plurality of blades 230, for example, seven blades 230 in FIG. 2 are welded to both the shroud 220 and the hub plate 210. Also, because of burrs, etc. generated when the plurality of blades are welded to the shroud and the hub plate, the appearance quality of the three-dimensional turbofan is not good.

Accordingly, the development of a new turbofan that can reduce the power consumption and noise in comparison to the two-dimensional turbofan and that can reduce the production cost and enhance the appearance quality compared to the three-dimensional turbofan has been required.

SUMMARY

The present disclosure has been developed in order to overcome the above drawbacks and other problems associated with the conventional arrangement. An aspect of the present disclosure relates to a turbofan that can reduce power consumption and noise in comparison to a two-dimensional turbofan and that can reduce production cost and enhance appearance quality compared to a three-dimensional turbofan, and an air conditioning apparatus using the same.

According to an aspect of the present disclosure, a turbofan for an air conditioning apparatus may include a shroud at a center of which a suction port is formed; a hub plate which is spaced apart in a vertical direction from the shroud and has a diameter smaller than a diameter of the suction port; and a plurality of blades provided between the hub plate and the shroud in a circumferential direction, wherein a portion of each of the plurality of blades which faces the suction port of the shroud is formed in a curved portion inclined with respect to the hub plate, and an outer circumference of the hub plate is provided with a plurality of notches each of which is formed between adjacent two blades among the plurality of blades.

Each of the plurality of notches may include a first side formed along a portion of the blade which is disposed on the hub plate and a second side formed to connect an end point of the first side and a point at which the adjacent blade and the outer circumference of the hub plate cross each other.

The second side may be formed as a curve.

Each of the plurality of blades may include a vertical portion that is provided between the curved portion and the hub plate and is substantially perpendicular to the hub plate.

A portion of each of the plurality of blades which is fixed to the shroud may be substantially perpendicular to the shroud.

A portion of each of the plurality of blades which faces the suction port of the shroud may be provided with a stepped portion.

A height of a lower step of the stepped portion of a portion of the blade fixed to the hub plate may be higher than a height of a portion of the blade fixed to the shroud.

The shroud may be formed in a substantially hollow truncated conical shape, and a portion of each of the plurality of blades which is fixed to a bottom surface of the shroud may be extended to an inner surface of the truncated cone of the shroud.

A surface of the shroud on which the plurality of blades are not disposed may be provided with a plurality of shrinkage reducing ribs corresponding to the plurality of blades.

The shroud, the hub plate, and the plurality of blades may be formed in a single body.

The turbofan for an air conditioning apparatus may be molded by a mold comprising a upper die and a lower die that are separated in a vertical direction.

According to another aspect of the present disclosure, an air conditioning apparatus may include a housing including an air inlet opening and an air discharge port; a turbofan rotatably disposed in the housing and having one of the above-described features; and a bell mouth provided in the air inlet opening of the housing, wherein an end of the bell mouth is spaced apart from an end of each of portions of the plurality of blades which are disposed in the hub plate.

An inlet end of each of the plurality of blades facing the bell mouth may be provided with a stepped portion.

According to another aspect of the present disclosure, a mold for manufacturing a turbofan may include an upper die and a lower die to form a cavity corresponding to a turbofan for an air conditioning apparatus including one of the above-described features, wherein one of the upper die and the lower die may be provided with a plurality of cores which form the plurality of blades of the turbofan and are separated through the plurality of notches.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the present disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

Figure 1A:
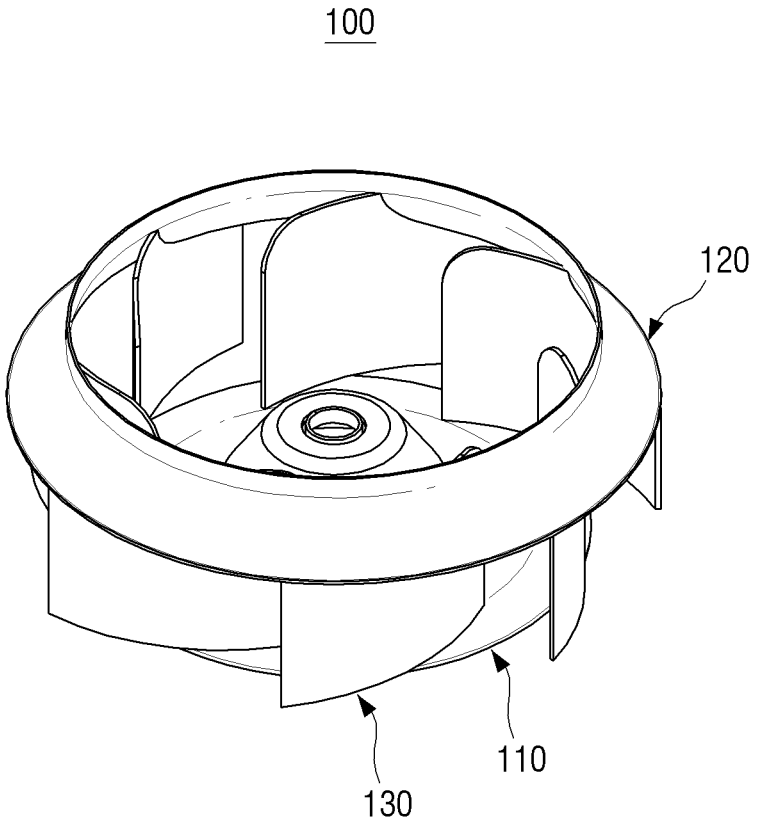
FIG. 1A is a perspective view illustrating a conventional two-dimensional turbofan used in an air conditioning apparatus.
Figure 1B:
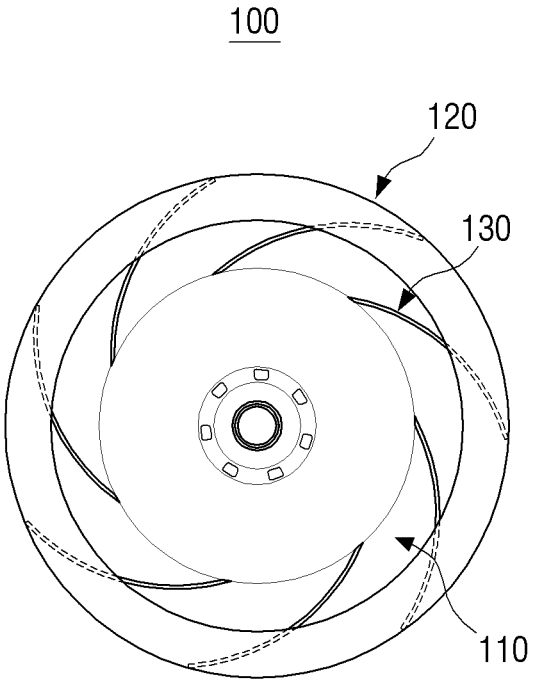
FIG. 1B is a plan view illustrating the two-dimensional turbofan of FIG. 1A.
Figure 2:
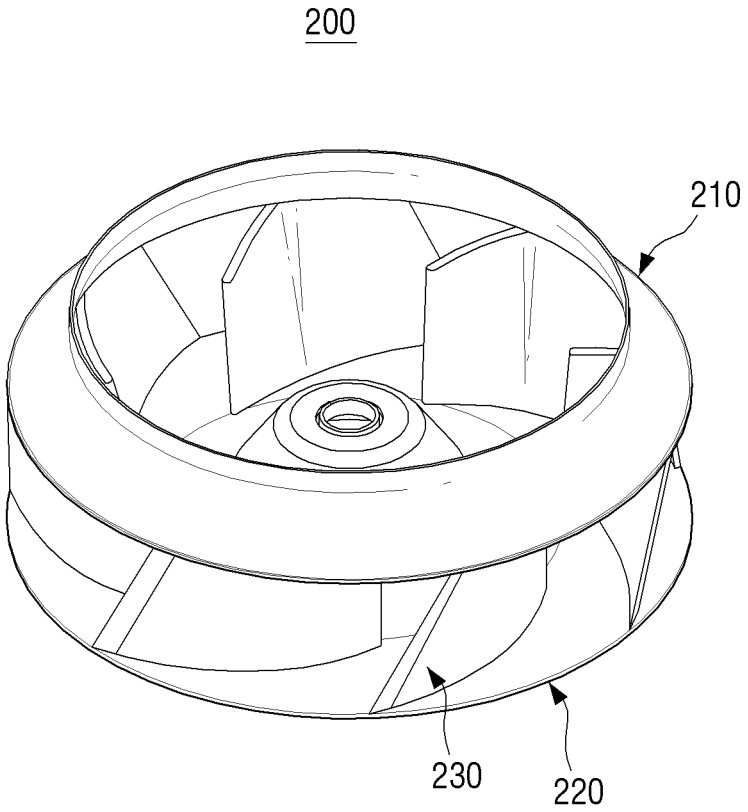
FIG. 2 is a perspective view illustrating a conventional three-dimensional turbofan used in an air conditioning apparatus.
Figure 3:
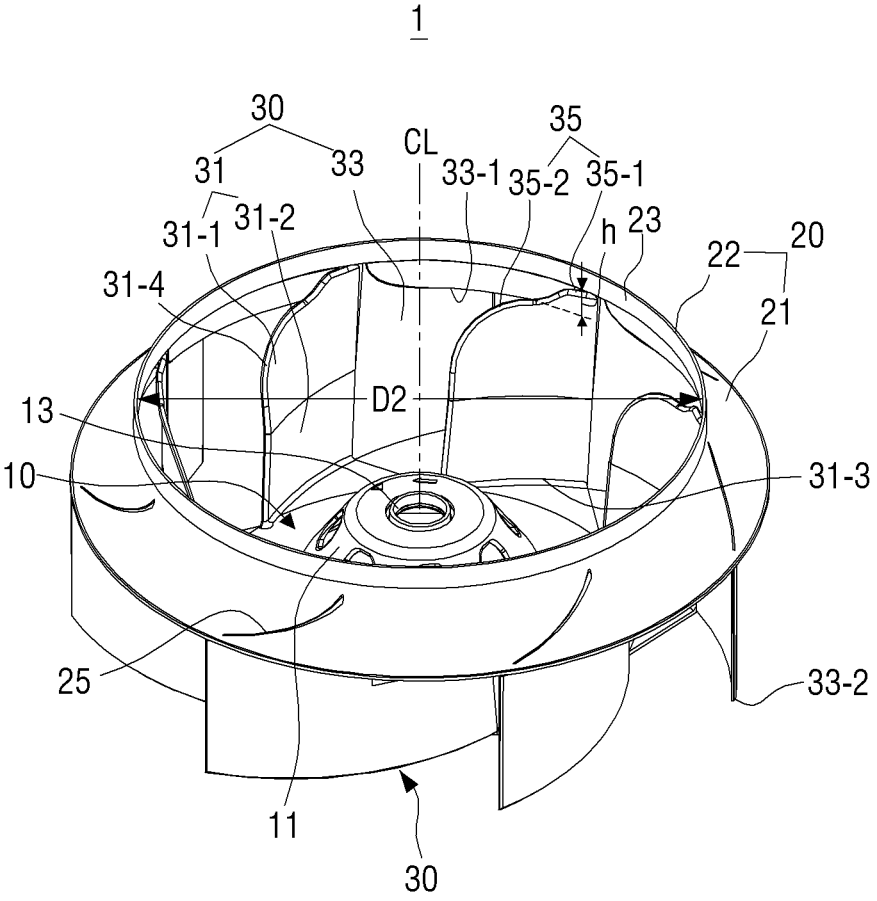
FIG. 3 is a perspective view illustrating a turbofan for an air conditioning apparatus according to an embodiment of the present disclosure.
Figure 4:
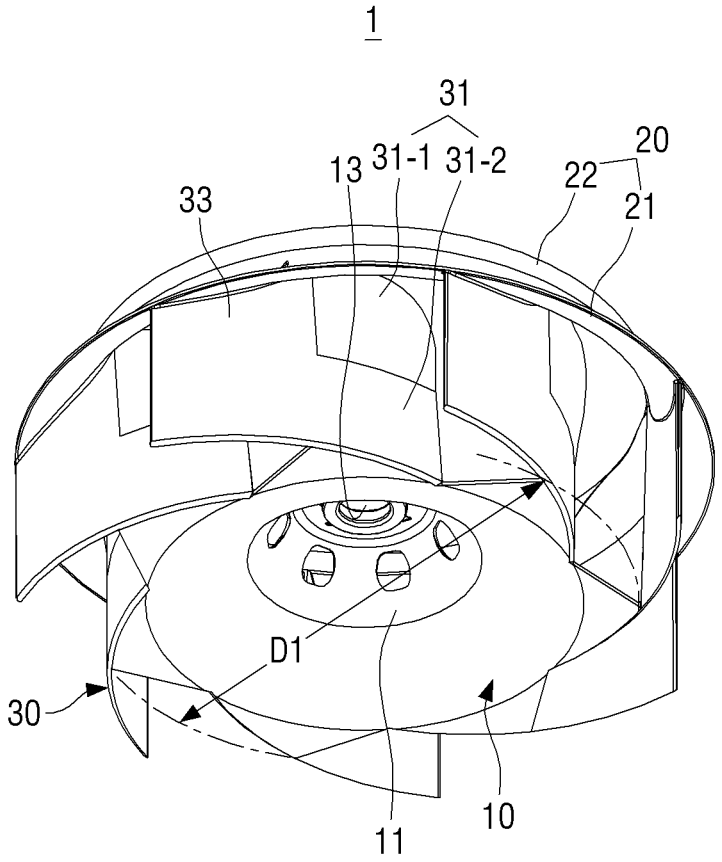
FIG. 4 is a rear perspective view illustrating the turbofan for an air conditioning apparatus of FIG. 3.
Figure 5:
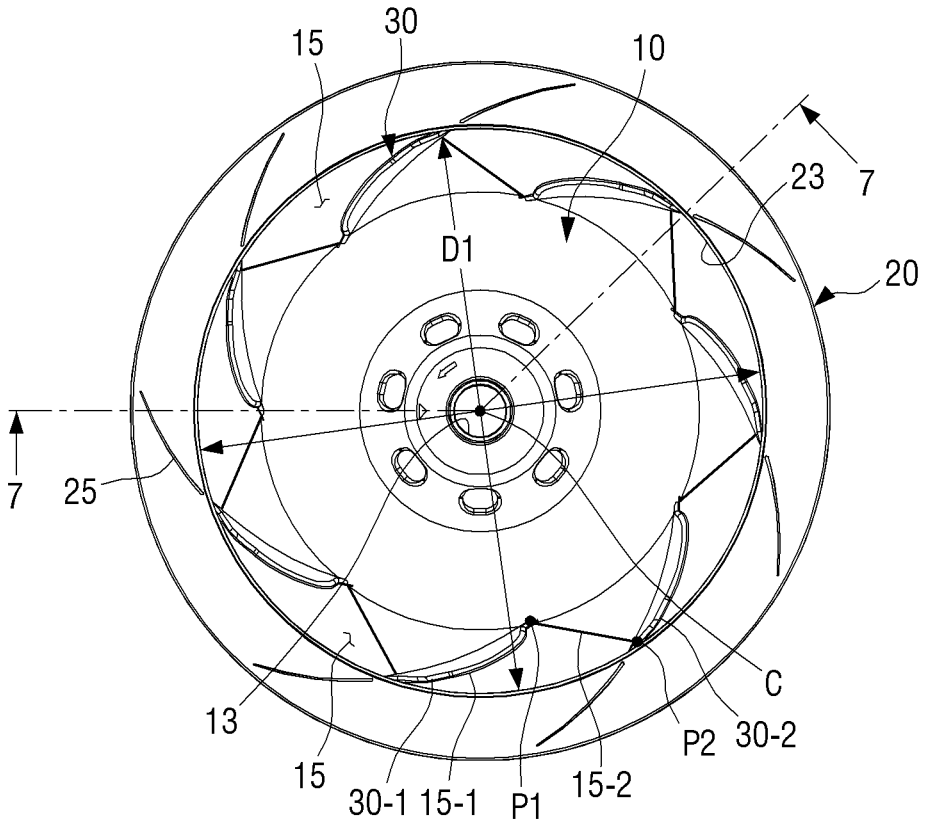
FIG. 5 is a plan view illustrating the turbofan for an air conditioning apparatus of FIG. 3.
Figure 6:
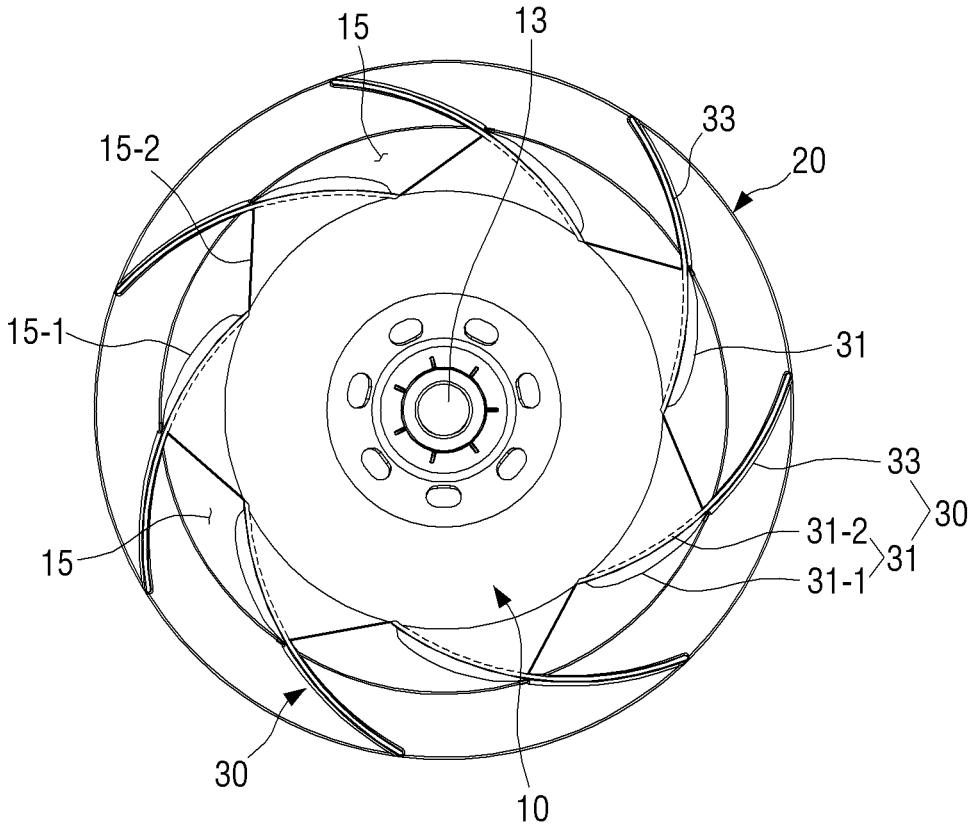
FIG. 6 is a rear view illustrating the turbofan for an air conditioning apparatus of FIG. 3.
Figure 7:
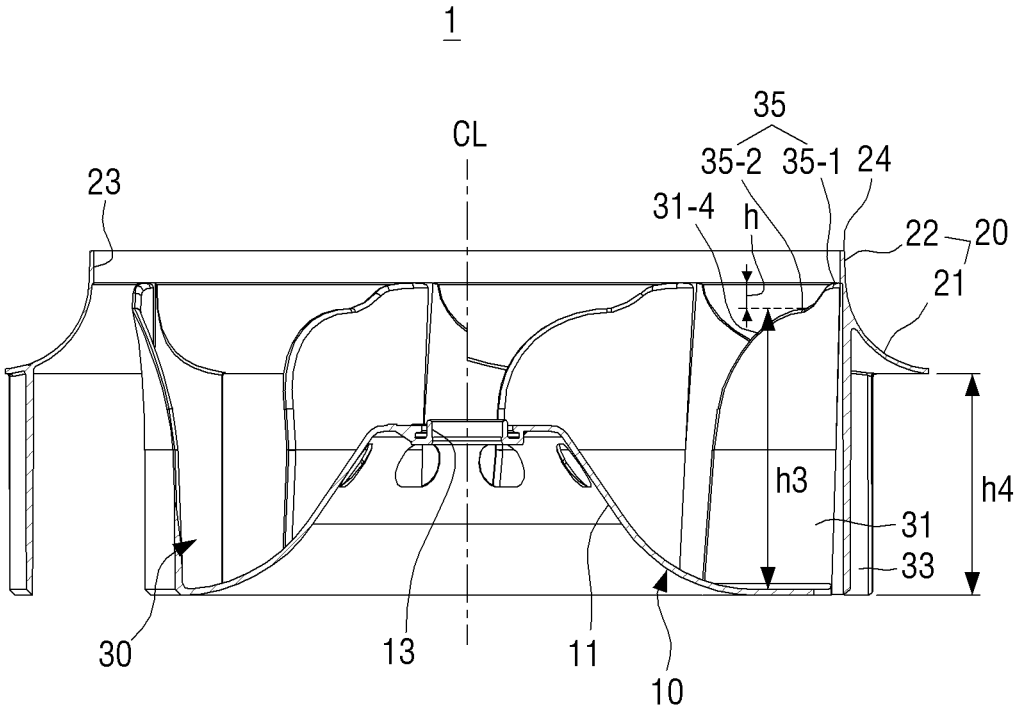
FIG. 7 is a cross-sectional view illustrating the turbofan for an air conditioning apparatus of FIG. 5 taken along a line 7-7.

FIG. 3 is a perspective view illustrating a turbofan for an air conditioning apparatus according to an embodiment of the present disclosure, and FIG. 4 is a rear perspective view illustrating the turbofan for an air conditioning apparatus of FIG. 3. FIG. 5 is a plan view illustrating the turbofan for an air conditioning apparatus of FIG. 3, and FIG. 6 is a rear view illustrating the turbofan for an air conditioning apparatus of FIG. 3. FIG. 7 is a cross-sectional view illustrating the turbofan for an air conditioning apparatus of FIG. 5 taken along a line 7-7.

Referring to FIGS. 3 to 7, a turbofan 1 for an air conditioning apparatus according to an embodiment of the present disclosure may include a hub plate 10, a shroud 20, and a plurality of blades 30.

The hub plate 10 is formed in a substantially disk shape, and is provided with a fixing portion 11 projecting toward the shroud 20 in the center of the hub plate 10. The fixing portion 11 is formed in a substantially truncated conical shape, and is provided with a through hole 13 in the center of the fixing portion 11. A rotation shaft of a motor 350 (see FIG. 12) to provide a driving force for rotating the hub plate 10 is fixed to the through hole 13.

The shroud 20 is spaced apart a predetermined distance from the hub plate 10, formed in a substantially disk shape, and is provided with a suction port 23 in the center of the shroud 20. In other words, the hub plate 10 is spaced apart a predetermined distance from the lower surface of the shroud 20 in the vertical direction along the center line CL of the hub plate 10. The suction port 23 is formed in a circular shape, and the diameter D2 of the suction port 23 is formed larger than the diameter D1 of the hub plate 10.

The shroud 20 may include a ring portion 21 of a ring shape and a projecting portion 22 projecting in a direction opposite to the hub plate 10 from an inner circumference of the ring portion 21. The projecting portion 22 may be formed in a substantially hollow truncated conical shape, and the diameter D2 of the top end of the projecting portion 22, that is, the diameter D2 of the suction port 23 is formed larger than the diameter D1 of the hub plate 10.

The plurality of blades 30 is provided between the hub plate 10 and the shroud 20. The plurality of blades 30 are disposed around the through hole 13 of the hub plate 10, and provided at predetermined intervals in a circumferential direction around the fixing portion 11. A portion of one end of the blade 30 is fixed to the hub plate 10, and a portion of the other end of the blade 30 is fixed to the shroud 20. All the plurality of blades 30 are formed in the same shape; therefore, the shape of one blade 30 will be described hereinafter.

Figure 8A:
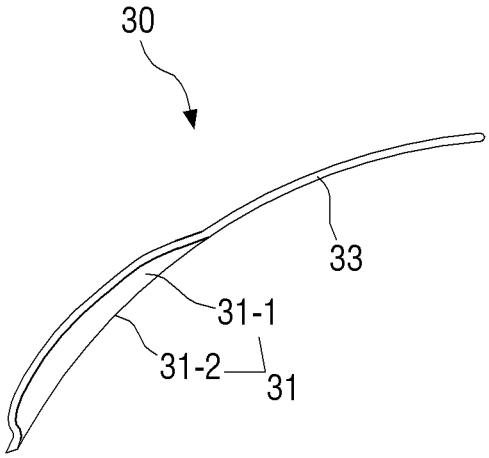
FIG. 8A is a plan view illustrating a blade of the turbofan for an air conditioning apparatus of FIG. 3.

FIG. 8A is a plan view illustrating a blade 30 of the turbofan 1 for an air conditioning apparatus of FIG. 3. As illustrated in FIG. 8A, the blade 30 is formed in a curved surface bent at a certain curvature. As illustrated in FIG. 5, the blade 30 is provided on the hub plate 10 so that the concave side of the blade 30 faces the center C of the hub plate 10 and the convex side of the blade 30 faces the outside of the hub plate 10.

Also, as illustrated in FIGS. 3, 4, 5, and 6, the blade 30 includes an inner portion 31 located on the hub plate 10 and an outer portion 33 which is beyond the hub plate 10 and is located below the shroud 20. The bottom end 31-3 of the inner portion 31 of the blade 30 is fixed to the outer circumferential portion of the hub plate 10 around the fixing portion 11. The top end 33-1 of the outer portion 33 of the blade 30 is fixed to the bottom surface of the shroud 20.

Referring to FIG. 3, the top end 31-4 of the inner portion 31 of the blade 30 faces the suction port 23 of the shroud 20, and forms an inlet end with which air flowing into the turbofan 1 is firstly in contact. Accordingly, the outside air passes through the inner portion 31 and the outer portion 33 of the blade 30 in sequence, thereby being discharged to the outside of the turbofan 1. In other words, the inner portion 31 of the blade 30 forms an entrance portion through which the outside air enters, and the outer portion 33 forms an exit portion through which the air is discharged.

Further, a corner of the top end 31-4 of the inner portion 31 of the blade 30 facing the suction port 23 of the shroud 20 is formed in a round shape. The bottom end 33-2 of the outer portion 33 of the blade 30 is not supported by the hub plate 10 and projects from the hub plate 10.

Figure 8B:
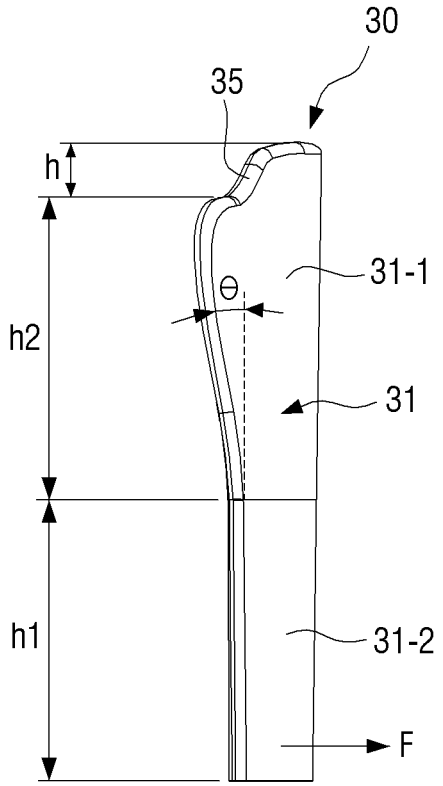
FIG. 8B is a side view illustrating a blade of the turbofan for an air conditioning apparatus of FIG. 3.

Also, the inner portion 31 of the blade 30, that is, a portion 31-1 of the blade 30 which extends from the hub plate 10 toward the shroud 20 and faces the suction port 23 of the shroud 20 may be formed to be inclined at a certain angle with respect to the hub plate 10. Accordingly, the portion 31-1 of the inner portion 31 of the blade 30 is formed in a curved portion which is bent at a certain curvature and inclined with respect to the hub plate 10 as illustrated in FIG. 8A. At this time, the curved portion 31-1, as illustrated in FIGS. 3 and 8B, may be formed to be inclined toward the outside of the hub plate 10, that is, in a direction opposite to the central direction F of the hub plate 10. Here, FIG. 8B is a side view illustrating a blade 30 of the turbofan 1 for an air conditioning apparatus of FIG. 3.

Further, the inner portion 31 of the blade 30, as illustrated in FIGS. 3 and 8B, may be formed to include a vertical portion 31-2 extended to a predetermined height h1 from the hub plate 10 and the curved portion 31-1 extended to a predetermined height h2 from the top of the vertical portion 31-2. The vertical portion 31-2 of the blade 30 is formed perpendicular to the hub plate 10. Accordingly, the vertical portion 31-2 is provided between the hub plate 10 and the curved portion 31-1 of the blade 30. In detail, the upper side of the inner portion 31 of the blade 30, that is, the portion of the blade 30 facing the suction port 23 of the shroud 20 is formed as the curved portion 31-1, and the lower side of the inner portion 31 of the blade 30, that is, a portion of the blade 30 fixed to the hub plate 10 is formed as the vertical portion 31-2. As illustrated in FIG. 8B, the curved portion 31-1 may be formed to be inclined at a certain angle θ in a direction away from the center C of the hub plate 10 with respect to the vertical portion 31-2. At this time, the inclination angle θ of the curved portion 31-1 may be about 10 to 15 degrees. Also, the height h2 of the curved portion 31-1 may be the same as or higher than the height h1 of the vertical portion 31-2.

When the upper side 31-1 of the inner portion 31 of the blade 30, that is, the portion of the blade 30 with which the air flowing in through the suction port 23 of the shroud 20 is firstly in contact is bent so as to be formed in a three-dimensional shape, the power consumption and noise of the turbofan 1 can be reduced like the conventional three-dimensional turbofan.

Further, the top end 31-4 of the inner portion 31 of the blade 30, that is, the portion of the blade 30 facing the suction port 23 of the shroud 20 may be provided with a stepped portion 35. The stepped portion 35 is formed such that the height of a portion 35-1 fixed to the shroud 20 is higher than the height of a portion 35-2 close to the center C of the hub plate 10. The height h of the stepped portion 35 may be appropriately determined depending on the size of the turbofan 1. For example, as illustrated in FIG. 7, the height h of the stepped portion 35 may be determined so that the height h3 of the lower step 35-2 of the stepped portion 35 of the inner portion 31 of the blade 30 is not lower than the height h4 of the outer portion 33 of the blade 30 fixed to the shroud 20. Also, the top end 31-4 of the inner portion 31 of the blade 30 may be formed not to protrude from the top end 24 of the shroud 20.

Figure 9:
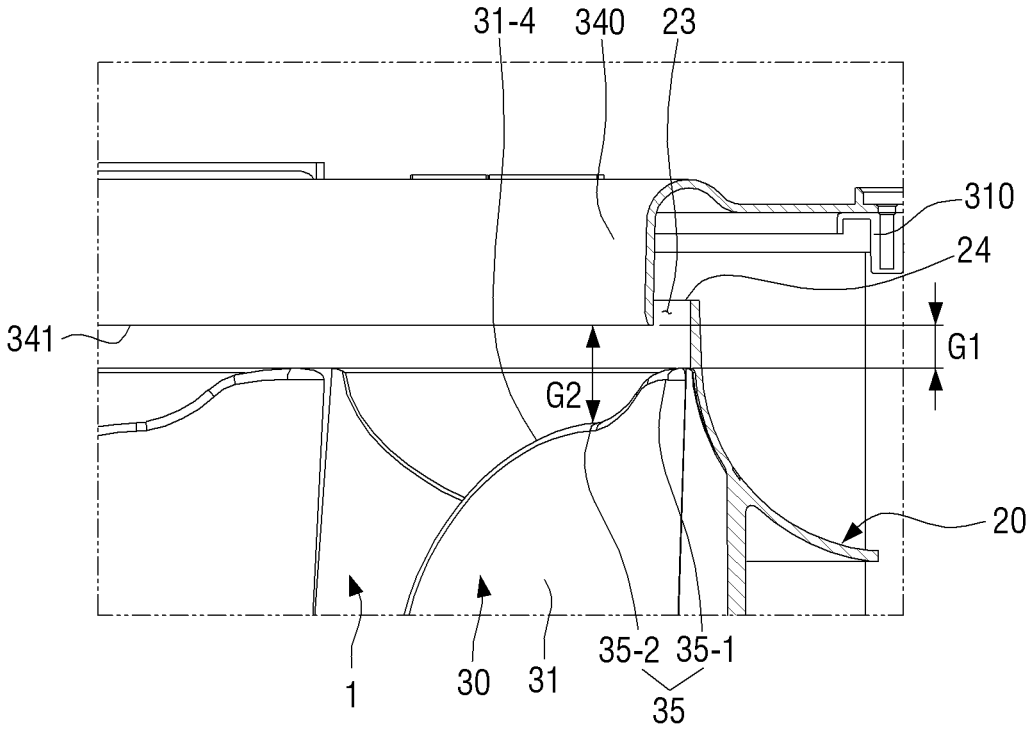
FIG. 9 is a view for explaining a relationship between a bell mouth and blades of a turbofan for an air conditioning apparatus according to an embodiment of the present disclosure.

FIG. 9 is a view for explaining a relationship between and a bell mouth 340 and blades 30 of a turbofan 1 for an air conditioning apparatus according to an embodiment of the present disclosure.

As illustrated in FIG. 9, an end 341 of the bell mouth 340 provided in a housing 310 in which the turbofan 1 is rotatably disposed is inserted in the suction port 23 of the shroud 20. At this time, the top end 31-4 of the inner portion 31 of the blade 30 is formed not to interfere with and to be spaced apart a predetermined distance G1 from the end 341 of the bell mouth 340. Further, when the above-described stepped portion 35 is formed in the top end 31-4 of the inner portion 31 of the blade 30, the distance G2 between the top end 31-4 of the blade 30 and the end 24 of the bell mouth 340 may be further increased, thereby reducing noise of the turbofan 1. In detail, the distance G2 between the lower step 35-2 of the stepped portion 35 of the top end 31-4 of the blade 30 and the end 24 of the bell mouth 340 is increased, thereby reducing the noise of the turbofan 1.

The outer portion 33 of the blade 30, that is, the portion 33 of the blade 30 fixed to the bottom surface of the shroud 20 is formed perpendicular to the bottom surface of the shroud 20. Accordingly, the outer portion 33 of the blade 30 is formed perpendicular to the hub plate 10 like the vertical portion 31-2 of the inner portion 31 of the blade 30. If the outer portion 33 of the blade 30 is perpendicular to the bottom surface of the shroud 20 as described above, when molding the turbofan 1 using a mold, the blade 30 may be prevented from interfering with a core of the mold.

As illustrated in FIG. 3, the outer portion 33 of the blade 30 may be formed to extend to the inner surface of the projecting portion 22 of the shroud 20 formed in a substantially hollow truncated conical shape. Also, the top surface of the shroud 20, that is, a surface of the shroud 20 on which the plurality of blades 30 are not disposed may be provided with a plurality of shrinkage reducing ribs 25 corresponding to the plurality of blades 30 fixed to the bottom surface of the shroud 20. Each of the shrinkage reducing ribs 25 is formed in a curve corresponding to the cross-section of each of the blades 30 provided below the shroud 20, and is formed in a long prominence shape with a certain height. If the plurality of shrinkage reducing ribs 25 are provided, when the turbofan 1 is molded, the amount of shrinkage of the shroud 20 may be reduced.

As illustrated in FIGS. 4, 5, and 6, the hub plate 10 is provided with a plurality of notches 15 which are formed in a substantially triangular shape or a substantially wedge shape in the outer circumference of the hub plate 10. Here, FIGS. 5 and 6 are views for illustrating the plurality of notches 15 formed in the hub plate 10, and are a plan view and a rear view of the turbofan 1 according to an embodiment of the present disclosure, respectively.

Referring to FIGS. 5 and 6, each of the plurality of notches 15 is formed between adjacent two blades 30 among the plurality of blades 30. The notch 15 includes a first side 15-1 and a second side 15-2 which form a predetermined angle. The first side 15-1 is a portion which is cut along a section of one blade 30-1 of the plurality of blades 30 which is disposed on the hub plate 10. The second side 15-2 is a portion which is cut along a line connecting an end point P1 of the first side 15-1, that is, a point corresponding to the end point of the portion of the blade 30-1 fixed to the hub plate 10 and a point P2 at which the adjacent blade 30-2 and the outer circumferential surface of the hub plate 10 cross each other. At this time, the second side 15-2 of the notch 15 may be formed in a curve or a straight line.

When the plurality of notches 15 are formed in the outer circumference of the hub plate 10, each of the plurality of notches 15 forms an opening which does not interfere with all of the shroud 20, the hub plate 10, and the blades 30, and penetrates the turbofan 1 in the center line CL direction. Accordingly, when the turbofan 1 according to an embodiment of the present disclosure is molded by a mold, a core of the mold for forming the blade 30 a portion of which is formed in a three-dimensional shape can pass through the notch 15 without interfering with the blades 30 and the hub plate 10.

Figure 10A:
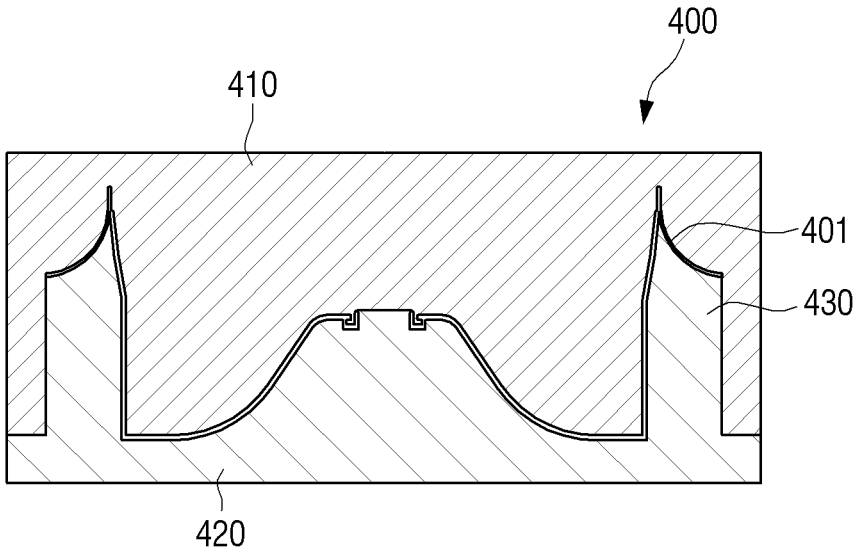
FIG. 10A is a view schematically illustrating a mold for molding a turbofan for an air conditioning apparatus according to an embodiment of the present disclosure.
Figure 10B:
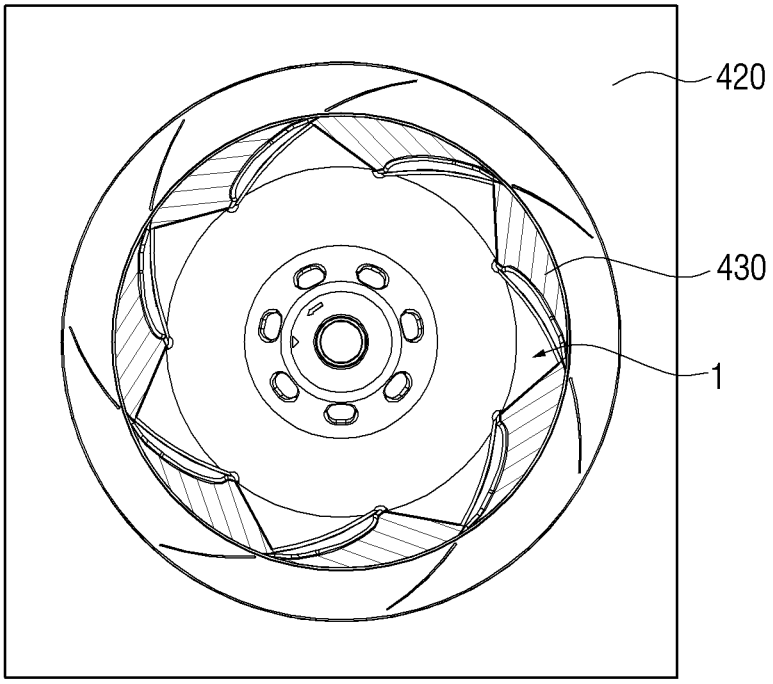
FIG. 10B is a view schematically illustrating a state in which a turbofan for an air conditioning apparatus according to an embodiment of the present disclosure is mounted to a lower die of FIG. 10A.

An example of a mold 400 that may be used to mold the turbofan 1 for an air conditioning apparatus according to an embodiment of the present disclosure is illustrated in FIGS. 10A and 10B.

FIG. 10A is a view schematically illustrating a mold for molding a turbofan for an air conditioning apparatus according to an embodiment of the present disclosure, and FIG. 10B is a view schematically illustrating a state in which a turbofan for an air conditioning apparatus according to an embodiment of the present disclosure is mounted to a lower die of FIG. 10A.

The turbofan 1 for an air conditioning apparatus according to an embodiment of the present disclosure may be molded by the mold 400 including an upper die 410 and a lower die 420 without a separate slide die. After a turbofan 1 is molded in a cavity 401 of the mold 400, cores for molding the entrance portions of the plurality of blades 30, which are twisted in a three-dimensional shape, may be separated through the plurality of notches 15 provided in the hub plate 10 as illustrated in FIG. 10B.

Accordingly, when the hub plate 10 is provided with the plurality of notches 15, the turbofan 1 according to an embodiment of the present disclosure may be molded in a single product using the mold 400 including the upper die 410 and the lower die 420 without the slide core as illustrated in FIG. 10A. Therefore, the production cost of the turbofan 1 may be reduced.

In other words, the turbofan 1 for an air conditioning apparatus according to an embodiment of the present disclosure may be formed in a single body so that the shroud 20, the hub plate 10, and the plurality of blades 30 are not separated. In detail, the turbofan 1 for an air conditioning apparatus according to an embodiment of the present disclosure may be molded by a single mold unlike the conventional three-dimensional turbofan. Accordingly, because it is not required that the shroud 20, the hub plate 10, and the plurality of blades 30 are molded by separate molds and then assembled by ultrasonic welding or laser welding, the production cost may be decreased.

Hereinafter, an air conditioning apparatus to which a turbofan according to an embodiment of the present disclosure is applied will be described with reference to FIGS. 11 and 12.

Figure 11:
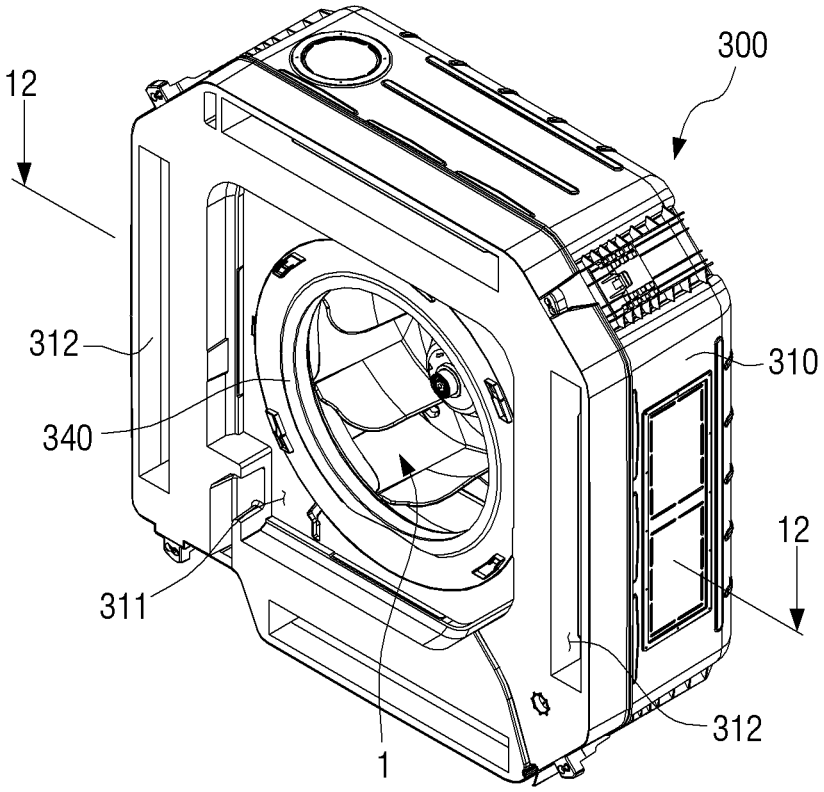
FIG. 11 is a perspective view illustrating a ceiling air conditioning apparatus using a turbofan for an air conditioning apparatus according to an embodiment of the present disclosure.

FIG. 11 is a perspective view illustrating a ceiling air conditioning apparatus in which a turbofan for an air conditioning apparatus according to an embodiment of the present disclosure is used. FIG. 12 is a cross-sectional view illustrating the ceiling air conditioning apparatus of FIG. 11 taken along a line 12-12.

Figure 12:
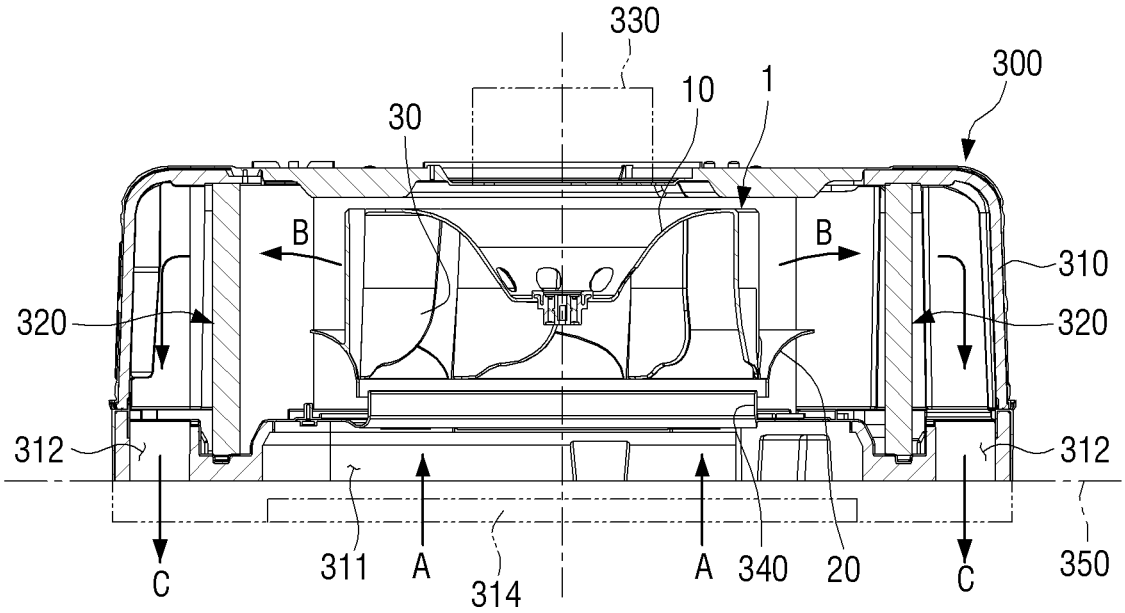
FIG. 12 is a cross-sectional view illustrating the ceiling air conditioning apparatus of FIG. 11 taken along a line 12-12.

For reference, the air conditioning apparatus 300 as illustrated in FIGS. 11 and 12 is a ceiling air conditioning apparatus; however, the present disclosure is not limited thereto. The turbofan 1 according to an embodiment of the present disclosure may be used in various types of air conditioning apparatuses.

Referring to FIGS. 11 and 12, the air conditioning apparatus 300 may include a housing 310, a heat exchanger 320, and a turbofan 1.

The housing 310 is formed in a substantially hollow rectangular parallelepiped, forms an appearance of the air conditioning apparatus 300, and is provided in a ceiling 350. The bottom surface of the housing 310 is provided with an air inlet opening 311 which is exposed to the outside of the ceiling 350 and faces the suction port 23 of the turbofan 1. Also, the bottom surface of the housing 310 is provided with a plurality of air discharge ports 312 around the air inlet opening 311. A filter to filter incoming air may be disposed below the air inlet opening 311.

The turbofan 1 is disposed in the center of the housing 310, and is rotated by a motor 330 provided in the upper side of the housing 310. The turbofan 1 includes the shroud 20, the hub plate 10, and the plurality of blades 30. The structure of the turbofan 1 is the same as or similar to the structure of the turbofan 1 according to the above-described embodiment; therefore, a detailed description thereof will be omitted.

A bell mouth 340 for stabilizing the incoming air is provided between the shroud 20 of the turbofan 1 and the bottom surface of the housing 310 in which the air inlet opening 311 is formed. Also, a gap may be provided between an end 341 of the bell mouth 340 and portions of the plurality of blades 30 of the turbofan 1 facing the bell mouth 340.

The heat exchanger 320 is provided so as to surround the turbofan 1 inside the housing 310. The heat exchanger 320 cools the air by exchanging heat with the air passing through the heat exchanger 320.

When the motor 330 rotates the turbofan 1, a negative pressure is generated in the inside of the turbofan 1 so that the outside air flows into the suction port 23 of the turbofan 1 through the filter 314. The air flowing into the suction port 23 of the turbofan 1 is discharged to the heat exchanger 320 provided around the turbofan 1 by the plurality of blades 30. The air discharged by the turbofan 1 is cooled while passing by the heat exchanger 320. The cooled air is discharged through the air discharge ports 312 of the housing 310, thereby cooling a room in which the air conditioning apparatus 300 is disposed.

Hereinafter, improved performance of the air conditioning apparatus that uses a turbofan according to an embodiment of the present disclosure having a structure as described above will be described in detail with reference to FIGS. 13A to 18.

Performance of the air conditioning apparatus 300 receives much influence by the distribution of the air flow being formed by the turbofan 1.

Figure 13A:
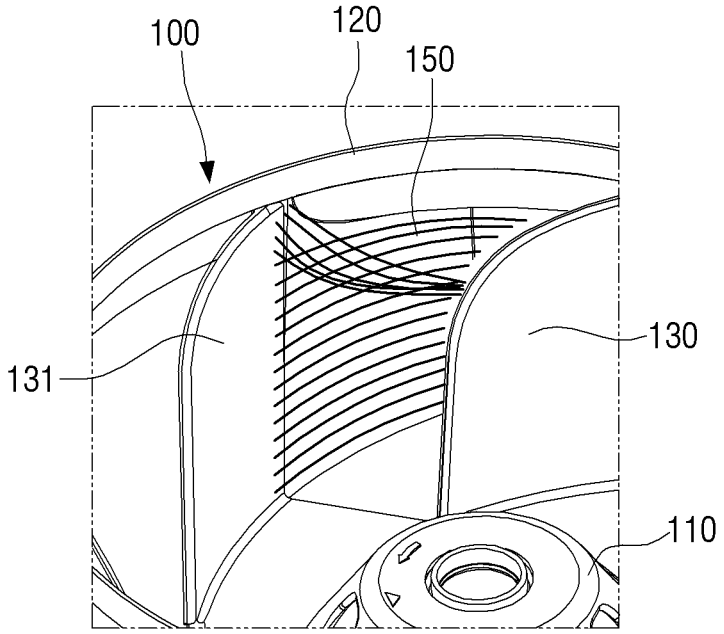
FIGS. 13A and 13B are views illustrating a flow of air in blades of a conventional two-dimensional turbofan.
Figure 13B:
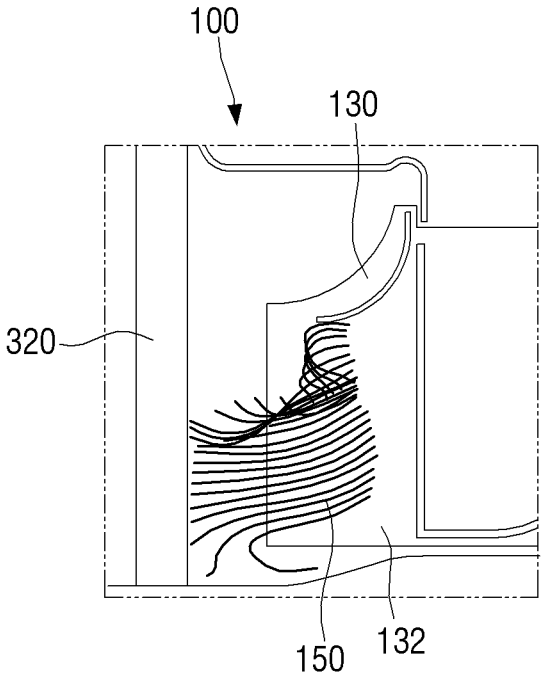
Figure 14A:
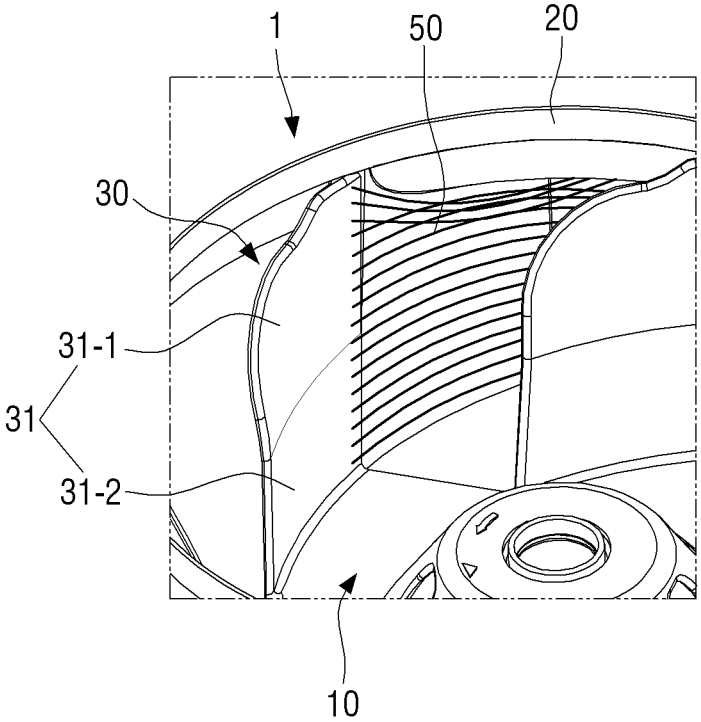
FIGS. 14A and 14B are views illustrating a flow of air in blades of a turbofan for an air conditioning apparatus according to an embodiment of the present disclosure.
Figure 14B:
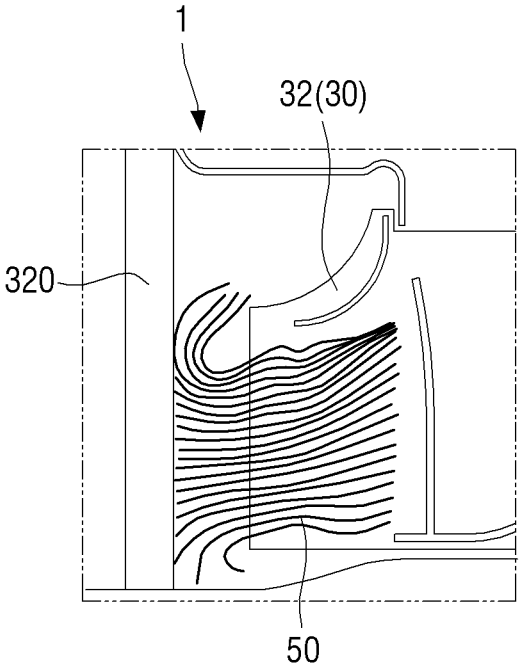

FIGS. 13A and 13B are views illustrating a flow of air in a blade of a conventional two-dimensional turbofan. FIGS. 14A and 14B are views illustrating a flow of air in a blade of a turbofan for an air conditioning apparatus according to an embodiment of the present disclosure. FIGS. 13A to 14B show results obtained by computer simulation.

Referring to FIG. 13A, it can be seen that a lot of turbulence 150 occur at a separation point of the entrance portion 131 of the blade 130 of the conventional two-dimensional turbofan 100. In the exit portion 132 of the blade 130, due to the influence of the turbulence 150, as illustrated in FIG. 13B, the flow field of air is distributed in approximately half the height of the blade 130.

However, in the turbofan 1 for an air conditioning apparatus according to an embodiment of the present disclosure, as illustrated in FIG. 14A, compared to the conventional two-dimensional turbofan 100, less turbulence 50 occurs at the separation point of the entrance portion 31 of the blade 30 by the effect of the curved portion 31-1. In the turbofan 1 for an air conditioning apparatus according to an embodiment of the present disclosure, since the turbulence 50 occurs less, the flow field of air is distributed over substantially the entire height of the blade 30 in the exit portion 32 of the blade 30 as illustrated in FIG. 14B.

Figure 15:
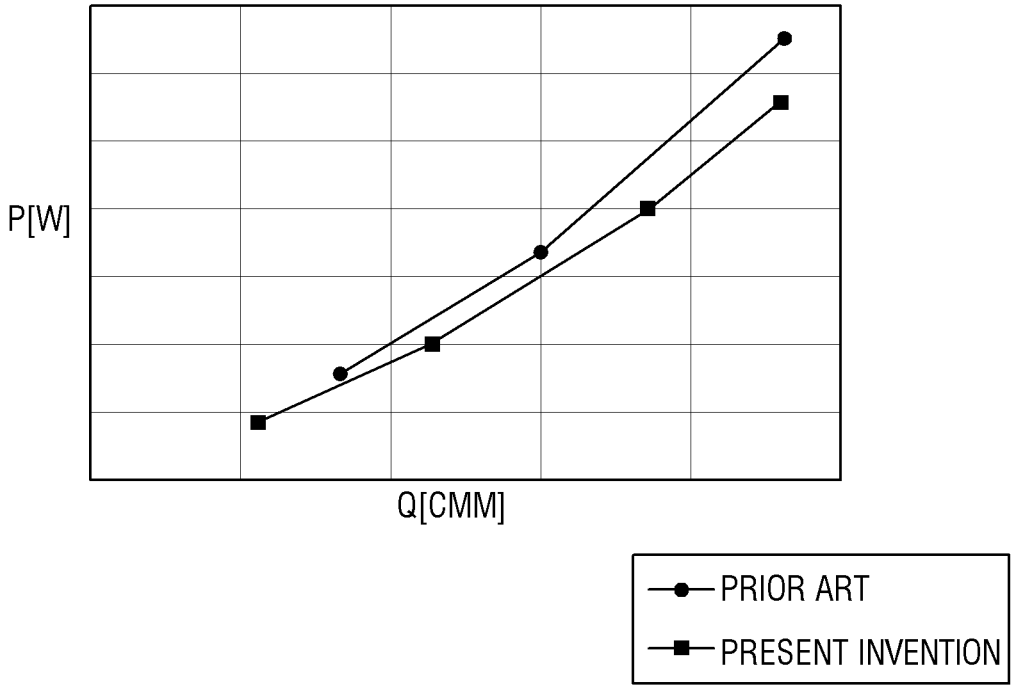
FIG. 15 is a graph comparing power consumption of a turbofan for an air conditioning apparatus according to an embodiment of the present disclosure and a conventional two-dimensional turbofan.
Figure 16:
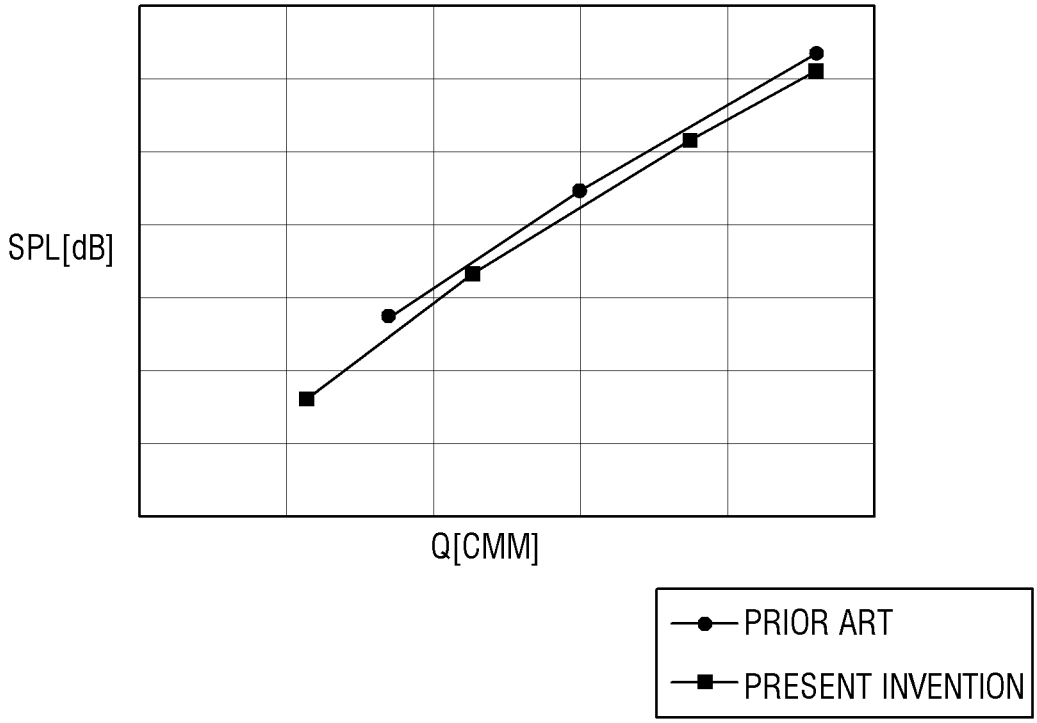
FIG. 16 is a graph comparing noise of a turbofan for an air conditioning apparatus according to an embodiment of the present disclosure and a conventional two-dimensional turbofan.

The results of measuring power consumption and noise of the turbofan 1 according to an embodiment of the present disclosure and the conventional two-dimensional turbofan are shown in FIGS. 15 and 16.

FIG. 15 is a graph comparing power consumption of a turbofan for an air conditioning apparatus according to an embodiment of the present disclosure and the conventional two-dimensional turbofan. FIG. 16 is a graph comparing noise of a turbofan for an air conditioning apparatus according to an embodiment of the present disclosure and the conventional two-dimensional turbofan.

In FIGS. 15 and 16, measurement data of the turbofan 1 according to an embodiment of the present disclosure are measured after replacing the two-dimensional turbofan 100 of the air conditioning apparatus, which is provided with the two-dimensional turbofan 100 and is used in the experiment, with the turbofan 1 according to an embodiment of the present disclosure.

Referring to FIG. 15, it can be seen that the power consumption of the turbofan 1 according to an embodiment of the present disclosure is decreased about 11% at the same flow rate as compared to the conventional two-dimensional turbofan. In FIG. 15, P represents the power consumption (unit; W) of the turbofan, and Q represents the flow rate (unit; CMM) of the turbofan.

Referring to FIG. 16, it can be seen that the noise of the turbofan 1 according to an embodiment of the present disclosure is decreased about 0.5 dB at the same flow rate as compared to the conventional two-dimensional turbofan. In FIG. 16, SPL (sound pressure level) represents the noise (unit; dB) generated by the turbofan, and Q represents the flow rate (unit; CMM) of the turbofan.

As described above, in the turbofan 1 according to an embodiment of the present disclosure, the power consumption and noise may be reduced in comparison to the conventional two-dimensional turbofan due to the substantially uniform air flow in the surface of the blade.

Figure 17:
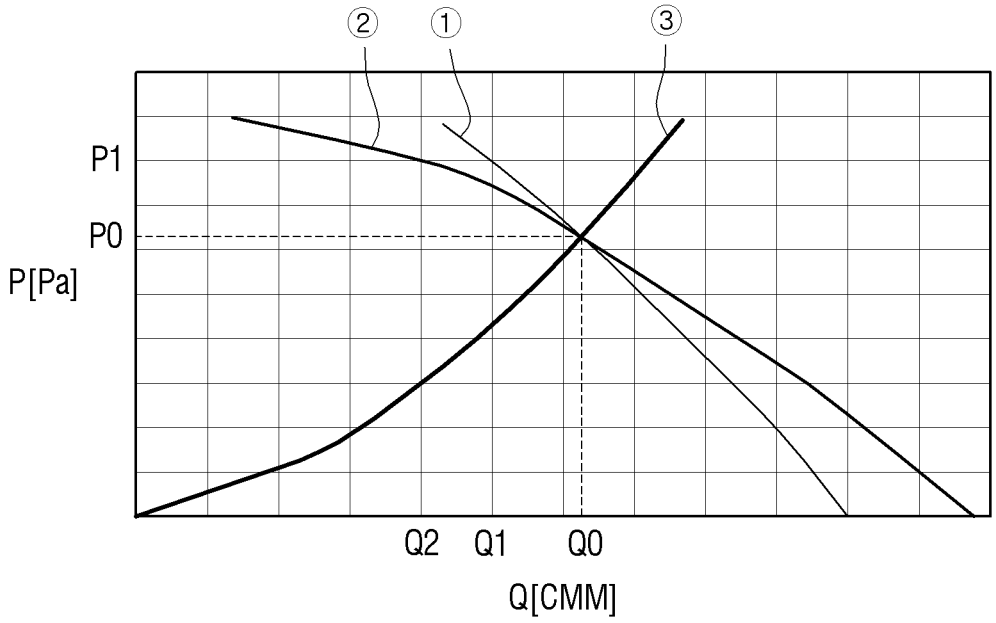
FIG. 17 is a graph comparing static pressure characteristics of a turbofan for an air conditioning apparatus according to an embodiment of the present disclosure and a conventional two-dimensional turbofan.

FIG. 17 is a P-Q graph comparing static pressure characteristics of a turbofan for an air conditioning apparatus according to an embodiment of the present disclosure and the conventional two-dimensional turbofan.

Referring to FIG. 17, it can be seen that the air volume reduction rate of the turbofan 1 for an air conditioning apparatus according to an embodiment of the present disclosure is less than that of the conventional two-dimensional turbofan 100 in the static pressure condition.

For example, in FIG. 17, when the static pressure that is P0 in the normal state rises to P1, in the turbofan 1 according to an embodiment of the present disclosure, the air volume is reduced from Q0 to Q1, and, in the conventional two-dimensional turbofan 100, the air volume is reduced from Q0 to Q2. Therefore, it can be seen that the air volume of the conventional two-dimensional turbofan is further decreased compared to that of the turbofan 1 according to an embodiment of the present disclosure. In FIG. 17, P represents the static pressure (unit; Pa) of the air conditioning apparatus, and Q represents the air volume (unit; CMM) of the air conditioning apparatus. Also, in FIG. 17, a curve ① is a line that represents the static pressure characteristic of the conventional two-dimensional turbofan, a curve ② is a line that represents the static pressure characteristic of the turbofan for an air conditioning apparatus according to an embodiment of the present disclosure, and a curve ③ represents a system resistance curve of the air conditioning apparatus.

Accordingly, when the static pressure of the air conditioning apparatus is increased, for example, due to dust accumulated on the filter provided in the air inlet opening, the performance degradation of the air conditioning apparatus using the turbofan 1 according to an embodiment of the present disclosure is less than that of the air conditioning apparatus using the conventional two-dimensional turbofan.

Also, the turbofan 1 according to an embodiment of the present disclosure may further reduce the noise by increasing the gap between the inlet end 31-4 of the blade 30 and the bell mouth 340 by forming the stepped portion 35 at the inlet end 31-4 of the blade 30 compared to the case in which the stepped portion is not formed at the inlet end 31-4 of each of the blades 30. The results are shown in FIG. 18.

Figure 18:
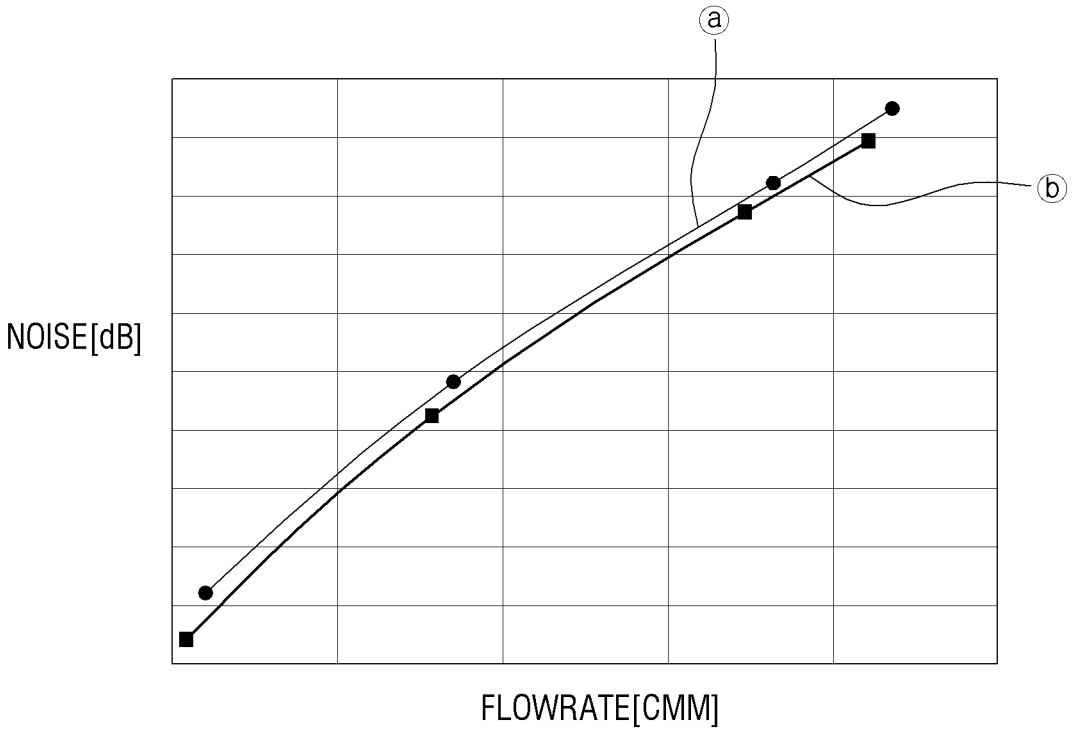
FIG. 18 is a graph illustrating noise reduction due to a stepped portion of a blade in a turbofan for an air conditioning apparatus according to an embodiment of the present disclosure.

Referring to FIG. 18, it can be seen that when the gap between the inlet end 31-4 of the blade 30 and the end 341 of the bell mouth 340 is increased as illustrated in FIG. 9 by forming the stepped portion 35 at the inlet end 31-4 of the blade 30 as illustrated in FIG. 3, the noise is reduced about 0.4 dB. In FIG. 18, a curve ⓐ is a line that represents noise of the turbofan in which the stepped portion is not formed at the inlet end 31-4 of the blade 30, and a curve ⓑ is a line that represents noise of the turbofan 1 in which the stepped portion 35 is formed at the inlet end 31-4 of the blade 30.

As described above, the turbofan for an air conditioning apparatus according to an embodiment of the present disclosure may reduce power consumption and noise compared to the conventional two-dimensional turbofan by forming the curved portion of a three-dimensional shape in an entrance portion of the blade.

Also, because the cores for forming the blades of a three-dimensional shape can pass through the notches provided in the hub plate, the turbofan 1 for an air conditioning apparatus according to an embodiment of the present disclosure may be formed by a single molding without the assembly of parts that are molded separately. Therefore, compared to the conventional three-dimensional turbofan, the production cost may be reduced and the appearance quality may be improved.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. A turbofan for an air conditioning apparatus comprising:

a shroud at a center of which a suction port is formed;

a hub plate which is spaced apart in a vertical direction from the shroud and has a diameter smaller than a diameter of the suction port; and a plurality of blades provided between the hub plate and the shroud in a circumferential direction, wherein each of the plurality of blades comprises an inner portion located on the hub plate and an outer portion located beyond the hub plate, the inner portion comprising a vertical portion and a curved portion, the vertical portion provided between the curved portion and the hub plate and substantially perpendicular to the hub plate, the curved portion inclined in a direction away from a center of the hub plate with respect to the vertical portion, and wherein an outer circumference of the hub plate is provided with a plurality of notches each of which is formed between all adjacent two blades among the plurality of blades.

2. The turbofan for an air conditioning apparatus of claim 1, wherein each of the plurality of notches includes a first side formed along a portion of the blade which is disposed on the hub plate and a second side formed to connect an end point of the first side and a point at which the adjacent blade and the outer circumference of the hub plate cross each other.

3. The turbofan for an air conditioning apparatus of claim 2, wherein the second side is formed as a curve.

4. The turbofan for an air conditioning apparatus of claim 1, wherein a portion of each of the plurality of blades which is fixed to the shroud is substantially perpendicular to the shroud.

5. The turbofan for an air conditioning apparatus of claim 1, wherein a portion of each of the plurality of blades which faces the suction port of the shroud is provided with a stepped portion.

6. The turbofan for an air conditioning apparatus of claim 5, wherein a height of a lower step of the stepped portion of a portion of the blade fixed to the hub plate is higher than a height of a portion of the blade fixed to the shroud.

7. The turbofan for an air conditioning apparatus of claim 1, wherein the shroud is formed in a substantially hollow truncated conical shape, and a portion of each of the plurality of blades which is fixed to a bottom surface of the shroud is extended to an inner surface of the truncated cone of the shroud.

8. The turbofan for an air conditioning apparatus of claim 1, wherein a surface of the shroud on which the plurality of blades are not disposed is provided with a plurality of shrinkage reducing ribs corresponding to the plurality of blades.

9. The turbofan for an air conditioning apparatus of claim 1, wherein the shroud, the hub plate, and the plurality of blades are formed in a single body.

10. The turbofan for an air conditioning apparatus of claim 9, wherein the turbofan for an air conditioning apparatus is molded by a mold comprising a upper die and a lower die that are separated in a vertical direction.

11. An air conditioning apparatus comprising:

a housing including an air inlet opening and an air discharge port;

a turbofan rotatably disposed in the housing; and a bell mouth provided in the air inlet opening of the housing, wherein the turbofan comprising:

a shroud at a center of which a suction port is formed;

a hub plate which is spaced apart in a vertical direction from the shroud and has a diameter smaller than a diameter of the suction port; and a plurality of blades provided between the hub plate and the shroud in a circumferential direction, wherein each of the plurality of blades comprises an inner portion located on the hub plate and an outer portion located beyond the hub plate, the inner portion comprising a vertical portion and a curved portion, the vertical portion provided between the curved portion and the hub plate and substantially perpendicular to the hub plate, the curved portion inclined in a direction away from a center of the hub plate with respect to the vertical portion wherein an outer circumference of the hub plate is provided with a plurality of notches each of which is formed between all adjacent two blades among the plurality of blades, and wherein an end of the bell mouth is spaced apart from an end of each of portions of the plurality of blades which are disposed in the hub plate.

12. The air conditioning apparatus of claim 11, wherein an inlet end of each of the plurality of blades facing the bell mouth is provided with a stepped portion.

13. A mold for manufacturing a turbofan comprising:

an upper die and a lower die to form a cavity corresponding to a turbofan for an air conditioning apparatus, wherein the turbofan for an air conditioning apparatus comprising:

a shroud at a center of which a suction port is formed;

a hub plate which is spaced apart in a vertical direction from the shroud and has a diameter smaller than a diameter of the suction port; and a plurality of blades provided between the hub plate and the shroud in a circumferential direction, wherein each of the plurality of blades comprises an inner portion located on the hub plate and an outer portion located beyond the hub plate, the inner portion comprising a vertical portion and a curved portion, the vertical portion provided between the curved portion and the hub plate and substantially perpendicular to the hub plate, the curved portion inclined in a direction away from a center of the hub plate with respect to the vertical portion wherein an outer circumference of the hub plate is provided with a plurality of notches each of which is formed between all adjacent two blades among the plurality of blades, and wherein one of the upper die and the lower die is provided with a plurality of cores which form the plurality of blades of the turbofan and are separated through the plurality of notches.

* * * * *